US010704545B2

(12) United States Patent
Liu et al.

(10) Patent No.: US 10,704,545 B2
(45) Date of Patent: Jul. 7, 2020

(54) ELECTRIC INFLATOR

(71) Applicant: Guangdong Travelmall Health Technology Co., Ltd., Dongguan (CN)

(72) Inventors: Zhiming Liu, Dongguan (CN); Yonggang Liu, Dongguan (CN); Congquan Wang, Dongguan (CN)

(73) Assignee: GUANGDONG TRAVELMALL HEALTH TECHNOLOGY CO., LTD., Dongguan (CN)

( * ) Notice: Subject to any disclaimer, the term of this patent is extended or adjusted under 35 U.S.C. 154(b) by 208 days.

(21) Appl. No.: 15/910,317

(22) Filed: Mar. 2, 2018

(65) Prior Publication Data

US 2018/0187671 A1 Jul. 5, 2018

(30) Foreign Application Priority Data

Nov. 28, 2017 (CN) ..... 2017 1 1215452

(51) Int. Cl.

| | |
|---|---|
| ***F04B 45/027*** | (2006.01) |
| ***F04B 35/04*** | (2006.01) |
| ***F04B 53/16*** | (2006.01) |
| ***F04B 35/06*** | (2006.01) |
| ***F04B 45/02*** | (2006.01) |
| *F04B 43/04* | (2006.01) |

(52) U.S. Cl.

CPC ..... *F04B 45/027* (2013.01); *F04B 35/04* (2013.01); *F04B 35/06* (2013.01); *F04B 45/022* (2013.01); *F04B 53/16* (2013.01); *F04B 43/043* (2013.01)

(58) Field of Classification Search

CPC ..... F04B 43/026; F04B 43/04; F04B 45/022; F04B 43/025; F04B 45/027; F04B 45/04; F04B 45/043; F04B 45/047

See application file for complete search history.

(56) References Cited

U.S. PATENT DOCUMENTS

| | | | | |
|---|---|---|---|---|
| 6,716,005 | B2 * | 4/2004 | Yamakawa | F04B 43/026 417/521 |
| 2007/0160485 | A1 * | 7/2007 | Huang | F04B 43/026 417/473 |
| 2014/0099222 | A1 * | 4/2014 | Yu | F04B 43/026 417/437 |
| 2017/0370357 | A1 * | 12/2017 | Fitzpatrick | F04B 45/043 |
| 2018/0010587 | A1 * | 1/2018 | Douglas | F04B 43/021 |

* cited by examiner

*Primary Examiner* — Dominick L Plakkoottam
(74) *Attorney, Agent, or Firm* — Shimokaji IP

(57) ABSTRACT

An electric inflator for connecting and inflating an inflatable device includes a shell, a drive motor configured on the axis of the shell, at least one air bag is configured in the shell and around the drive motor, an air outlet of the air bag connected to an inflatable device, and a pressing mechanism connected to an output portion of the drive motor. The air bag is pressed by the pressing mechanism driven by the drive motor for supplying air to the inflatable device. An inner space of the shell can be fully utilized thereby the size of the electric inflator is smaller than before. At the same time, an inner cavity of the air bag can be bigger than before to improve inflating efficiency, which increases portability and practicability of the electric inflator and the inflatable device equipped with the electric inflator.

14 Claims, 13 Drawing Sheets

ELECTRIC INFLATOR

CROSS-REFERENCE TO PRIOR APPLICATION

This application claims the benefit of Chinese patent application No. 201711215452.1, filed on Nov. 28, 2017, which is incorporated herein by reference.

FIELD OF THE INVENTION

The present invention relates to an inflator and, more particularly, to an electric inflator with an electric motor.

BACKGROUND OF THE INVENTION

Micro inflators are widely used in traveling since they have small volume are convenient to use. For example, inflatable mattresses, inflatable moisture-proof pads, or inflatable pillows, etc. with such a micro inflator are convenient for users.

Nowadays, most of the micro inflators inflate the inflatable device by manual operation, which is time-consuming and makes users tired. In view of it, some electric inflators are developed but not used widely unfortunately due to their big volumes and high costs.

Accordingly, it is desired to provide a small and low-cost electric inflator to overcome the above-mentioned drawbacks.

SUMMARY OF THE INVENTION

One objective of the present invention is to provide a small and low-cost electric inflator for using at home or traveling.

To achieve above objective, an electric inflator of the present invention adapted for connecting with an inflatable device includes a shell, a drive motor configured on an axis of the shell, at least one air bag configured in the shell and around the drive motor and provided with an air outlet which is communicated with an inflatable device, and a pressing mechanism connected to an output portion of the drive motor and driven by the drive motor to press the air bag for inflating the inflatable device.

Preferably, the drive motor is configured at one end of the shell, the output portion of the drive motor connected to the pressing mechanism is configured towards another end of the shell and rotatable along the axis of the shell, and the pressing mechanism includes a pressing section adapted for pressing the air bag and configured towards an end of the shell where is provided with the drive motor, the air bag is located between the pressing section and the end of the shell where is provided with the drive motor. According to mentioned structure, the air bag is pressed by the pressing mechanism connected to the output portion of the drive motor conveniently and completely to improve inflating efficiency.

Preferably, the pressing mechanism includes a driving member connected to the output portion of the drive motor and a pressing member configured in the shell, the pressing member is driven by the driving member and movable along an axis direction of the shell, and the pressing member is protruded towards the air bag to form the pressing section. Due to the configuration of the driving member and the pressing member, the air bag is pressed conveniently since a rotating force of the drive motor is transformed into a pressing force applied on the air bag.

As an embodiment of the present invention, the pressing member is sleeved on an outside wall of the drive motor and connected to the output portion of the drive motor, a guide surface is defined by forming a slot around the driving member, a drive end of the pressing member is plugged into the slot and movable along the axis direction of the shell thereby pressing the air bag under a driving action of the guide surface.

Preferably, the pressing member is connected to the outside wall of the driving member and movable up and down relative to the outside wall of the driving member. Concretely, the driving member is a cam driving member, the pressing member is movable along the axis direction of the shell under a driven action of a cam guide surface of the cam driving member.

As another embodiments of the present invention, an axis of the driving member is connected to the output portion of the drive motor, the pressing member is located between the air bag and the driving member, the guide surface is defined by the outside wall of the driving member protruded along the axis direction of the shell and towards the pressing member, and the driving member driven by the drive motor is rotatable and movable along the axis direction of the shell under a driving action of the guide surface. Concretely, the driving member is a cam driving member, and the pressing member is movable along the axis direction of the shell under a driven action of a cam guide surface of the cam driving member.

Preferably, a guide axis is configured in the shell and along the axis direction of the shell, a guide hole is provided on the pressing member to engage with the guide axis. The cam guide surface of the cam driving member is configured towards the pressing member for driving the pressing member which is movable along the direction of the guide axis. The pressing member is positioned by the guide axis to improve reliability of the electric inflator. Preferably, the air bag includes a plurality of columnar air bags or an annular air bag configured around the drive motor.

Preferably, an inflation inlet adapted for inflating the inflatable device is provided at an end of the drive motor, an inflation leaf is provided at the air bag and faced towards the end of the shell provided with the drive motor, an airtight structure is defined by an outer ring of the inflation leaf and an inside wall of the shell, a gap is defined by the inflation leaf and an inner side of the end of the shell provided with the drive motor, the air outlet of the air bag is configured at one end of the inflation leaf where is faced to the inflation inlet, and an inflating passageway is defined by the air outlet and the inflation inlet.

Preferably, the inflation leaf is provided with an air inlet to supply air for the air bag, a first check valve for preventing air flowing into the air bag is configured on the air inlet and a second check valve for preventing air flowing into the inflatable device is configured on the inflation inlet.

Preferably, the inflation leaf and the air bag are formed in an integrated structure.

Preferably, a spring support member is configured in the air bag and along the axis direction of the shell.

Preferably, the shell is extended towards the air bag to form a guide post on which the spring support member is sleeved.

As an embodiment of the present invention, the drive motor is configured at one end of the shell, the output portion of the drive motor is configured towards another end of the shell and rotatable along the axis of the shell, the air bag is configured around the inside wall of the shell and located between the output portion of the drive motor and the end of the shell where is provided with the drive motor, the pressing mechanism located between the air bag and the drive motor is driven by the drive motor and rotatable along the axis of the shell thereby pressing the air bag.

Preferably, the air bag is in a bowl shape.

Preferably, the pressing mechanism is a sector structure configured on the outside wall of the drive motor, a distance between an outside wall of the sector structure and the axis of the shell is longer than that between the air bag and the axis of the shell.

In comparison with the prior art, since the drive motor is configured on the axis of the shell and the air bag is configured around the drive motor, thus the inner space of the shell can be fully utilized and the volume of the electric inflator can be reduced. At the same time, an inner cavity of the air bag can be bigger than before to improve inflating efficiency, which increases portability and practicability of the electric inflator and the inflatable device with the electric inflator. Furthermore, the rotating force of the drive motor is transformed into the pressing force applied on the air bag by means of the pressing mechanism, thus the structure of the electric inflator is simple and reliable.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings. By all appearances, the embodiments to be described just are a part of embodiments of the present invention, not the all. Based on the embodiment of the present invention, all other embodiments obtained by the person ordinarily skilled in the art without any creative work pertain to the protection scope of the present invention.

Figure 11:
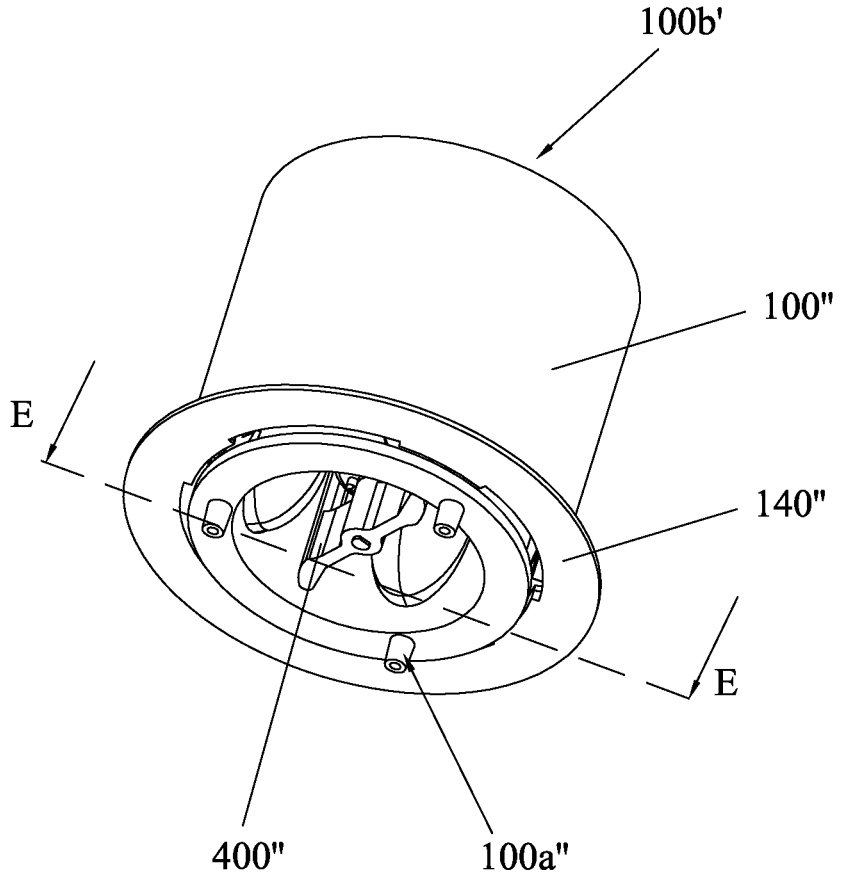
FIG. 11 is a perspective view of an electric inflator according to a third embodiment of the present invention.
Figure 12:
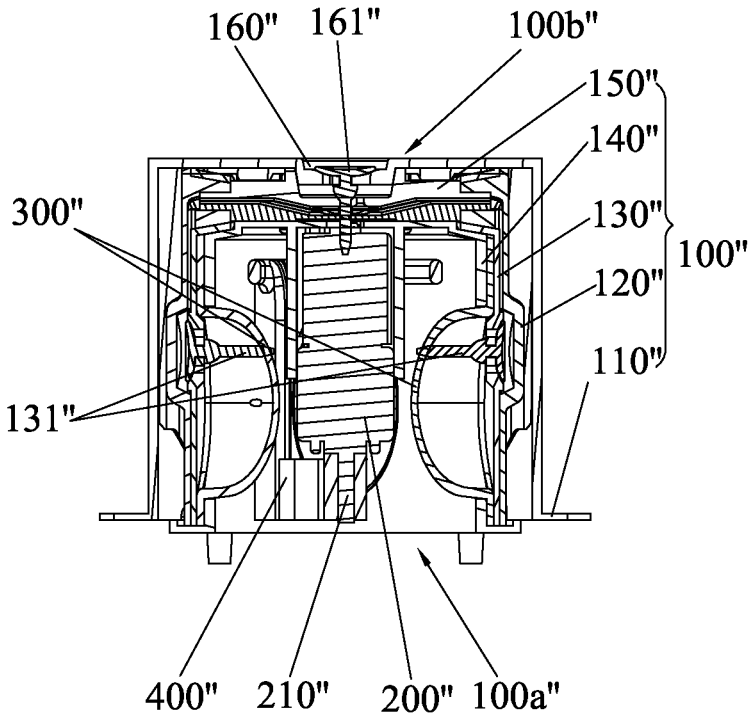
FIG. 12 is a cross section view of the electric inflator according to the third embodiment of the present invention along the direction of E-E.
Figure 13:
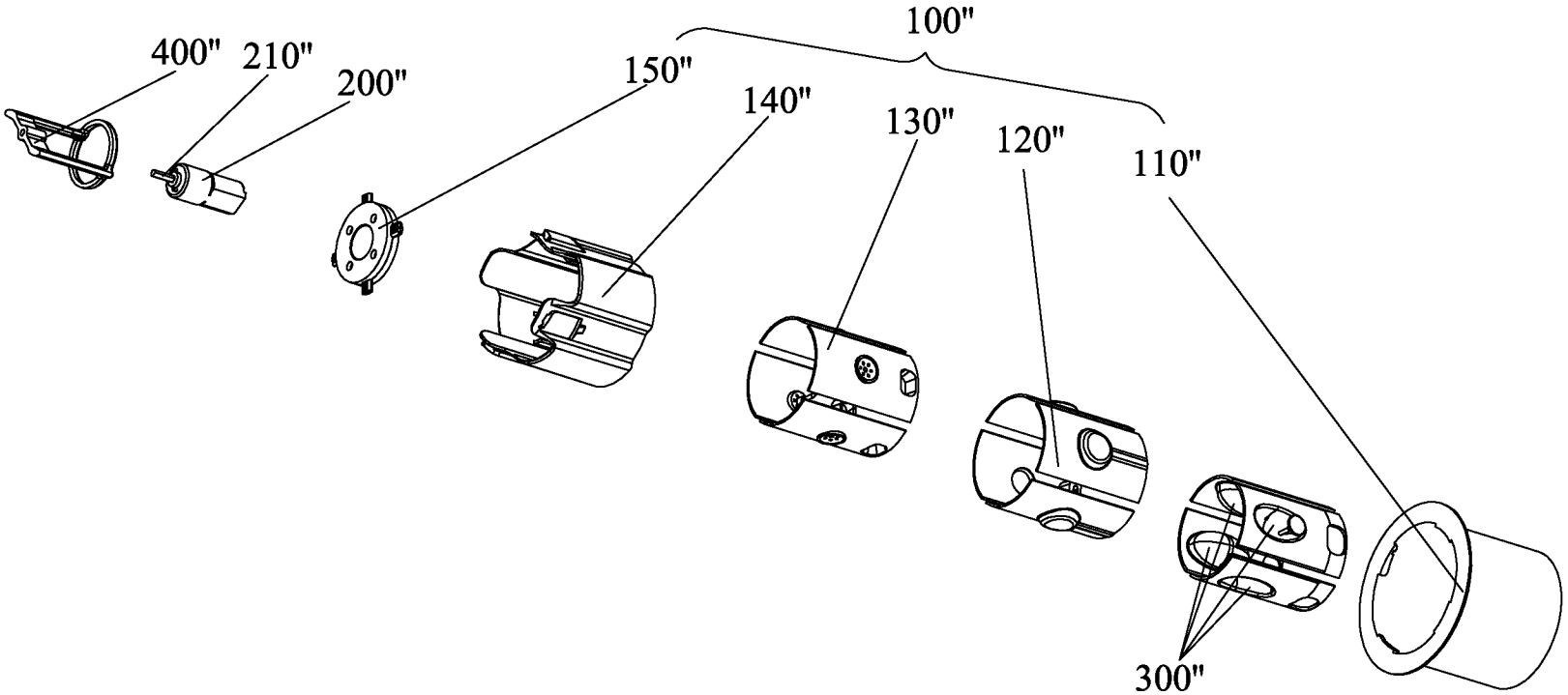
FIG. 13 is an exploded view of the electric inflator according to the third embodiment of the present invention.

As indicated above, the invention is directed to an electric inflator for inflating an inflatable device. The inflatable device includes inflatable mattress, inflatable moisture-proof pad, or inflatable pillow, etc. An electric inflator according to a first embodiment of the present invention is shown in FIGS. 1-5, an electric inflator according to a second embodiment of the present invention is shown in FIGS. 6-10, and an electric inflator according to a third embodiment of the present invention is shown in FIGS. 11-13. A detailed description on the electric inflator is shown below.

The electric inflator according to the first embodiment of the present invention is shown in FIGS. 1-5. There are some common structures of the electric inflators according to the first embodiment shown in FIGS. 1-5, the second embodiment shown in FIGS. 6-8 and the third embodiment shown in FIGS. 11-13. The common structures of the electric inflators include a shell 100, a drive motor 200 configured on an axis of the shell 100, at least one air bag 300 configured in the shell 100 and around the drive motor 200, an air outlet 310 of the air bag 300 connected to an inflatable device, and a pressing mechanism 400 connected to an output portion 210 of the drive motor 200. The pressing mechanism 400 is driven by the drive motor 200 to press the air bag 300 thereby blowing air into the inflatable device. In the present invention, an inner space of the shell 100 of the electric inflator is fully utilized, since the drive motor 200 is configured on the axis of the shell 100 and the air bag 300 is configured around the drive motor 200. Thus the size of the electric inflator is smaller than before. At the same time, an inner cavity of the air bag 300 is bigger than before, thus portability and practicability of the electric inflator and the inflatable device equipped with the electric inflator is improved. A rotating force of the drive motor 200 is transformed into a pressing force applied on the air bag 300 by means of the pressing mechanism 400, thus a structure of the electric inflator is simple and reliable.

Figure 1:
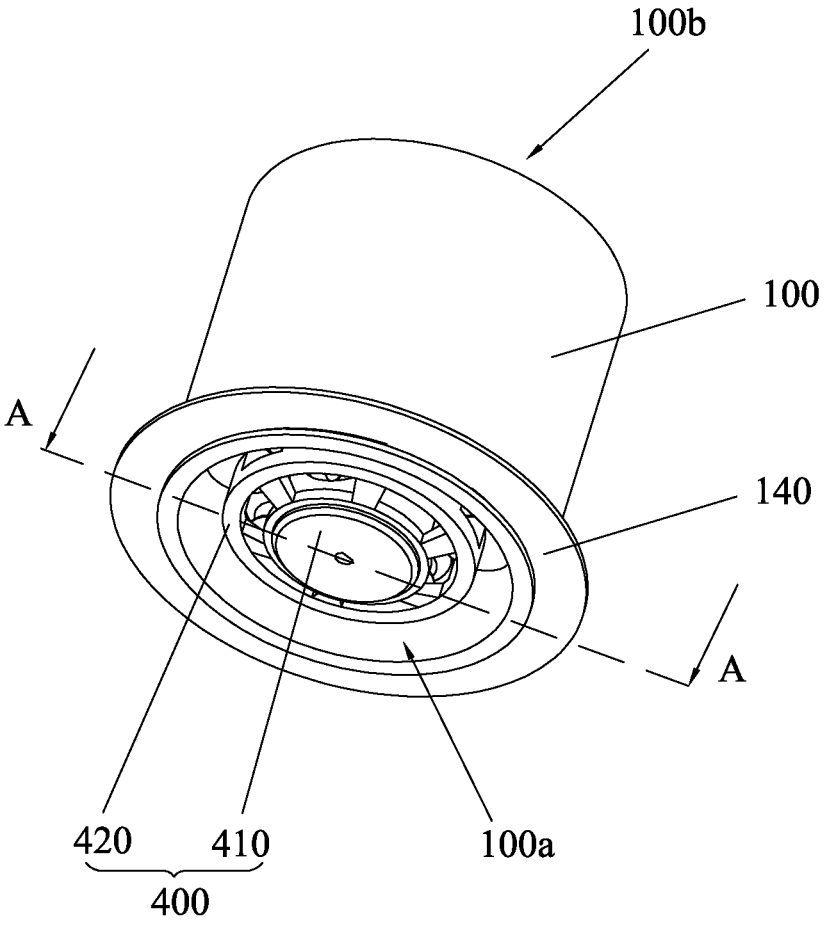
FIG. 1 is a perspective view of an electric inflator according to a first embodiment of the present invention.
Figure 2:
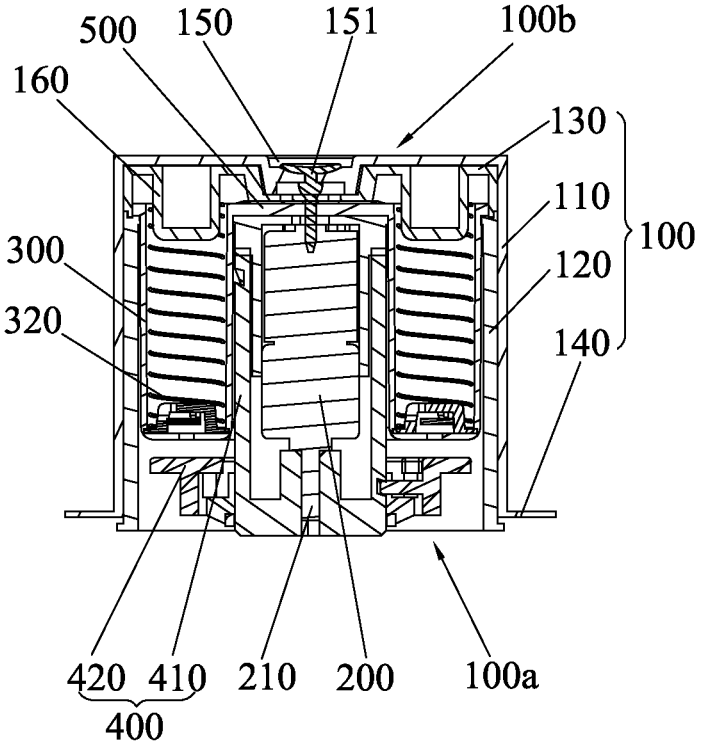
FIG. 2 is a cross section view of the electric inflator according to the first embodiment of the present invention along the direction of A-A.
Figure 3:
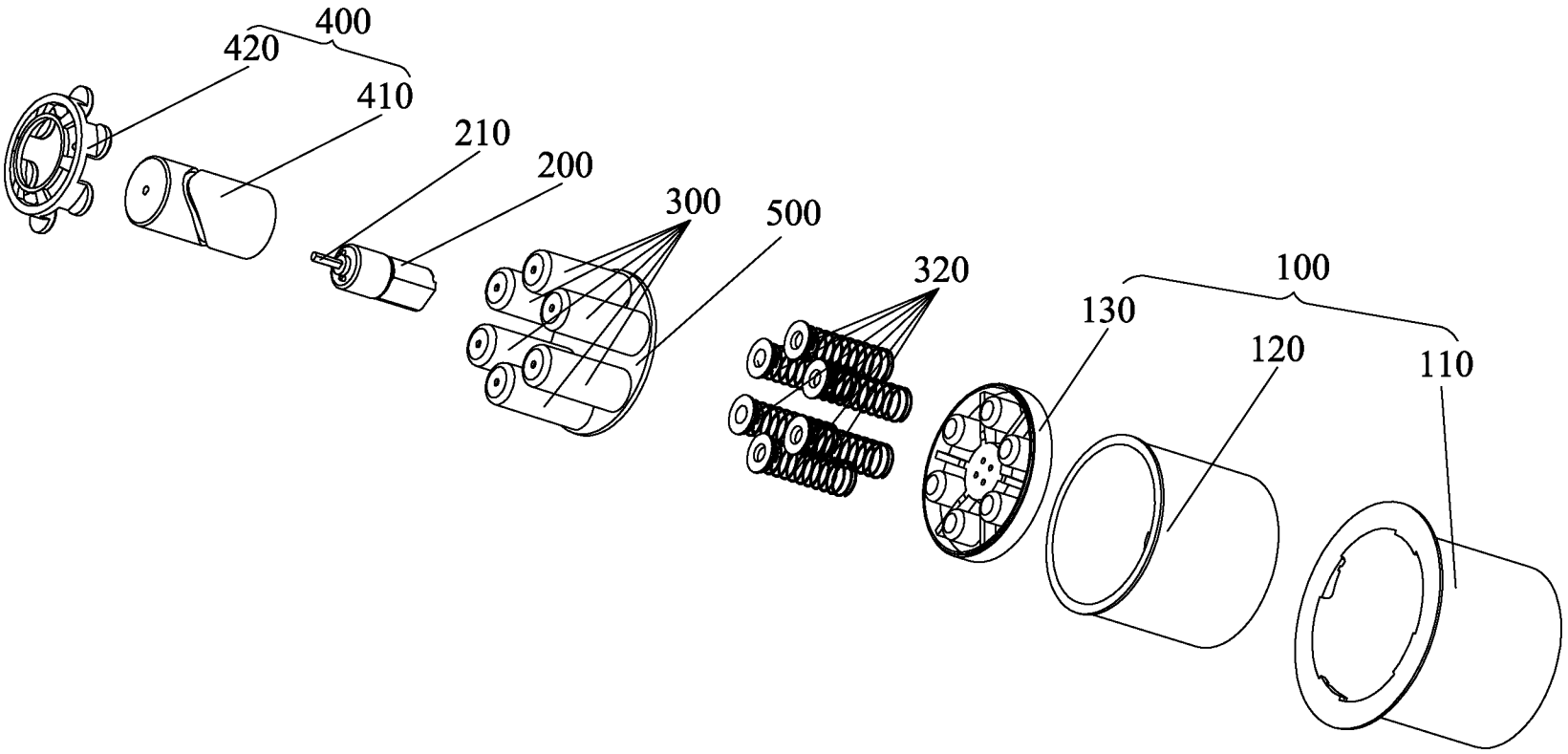
FIG. 3 is an exploded view of the electric inflator according to the first embodiment of the present invention.

Referring to FIG. 1-3, the electric inflator according to the first embodiment of the present invention includes the shell 100 connected to the inflatable device, the drive motor 200 connected to the axis of the shell 100, at least one air bag 300 configured in the shell 100 and around the drive motor 200, and the pressing mechanism 400 connected to the output portion 210 of the drive motor 200. An inflation inlet 150 configured on the shell 100 and towards the inflatable device is inflated to an inflatable cavity of the inflatable device. The air outlet 310 of the air bag 300 is connected to the inflatable cavity of the inflatable device through the inflation inlet 150 of the shell 100. The air bag 300 is pressed by the pressing mechanism 400 driven by the drive motor 200 thereby supplying the air in the air bag 300 to the inflatable cavity of the inflatable device through the inflation inlet 150 of the shell 100.

Referring to FIG. 1, in this embodiment, the shell 100 is nearly a columnar structure, a connecting flange 140 connected to the inflatable device is formed by an opening end 100*a* of the shell 100 which is extended to outside of the electric inflator. The electric inflator is connected to the inflatable device through the connecting flange 140, the electric inflator is configured in the inflatable cavity of the inflatable device, thus the volume of the inflatable device of the electric inflator is small and the electric inflator embedded in the inflatable cavity of the inflatable device will not be abrupt. A closing end 100*b* of the shell 100 is extended into the inflatable cavity of the inflatable device. The inflation inlet 150 is configured on the closing end 100*b* of the shell 100. The drive motor 200, the air bag 300 and the pressing mechanism 400 are operated to supply air to the inflatable cavity of the inflatable device through the inflation inlet 150 of the closing end 100*b*.

It is understandable that the electric inflator includes a power supply unit, which is a battery or a power module connected to an outer power supply device. In this embodiment, the power module or a battery storehouse is configured on the opening end 100*a* of the shell 100. Concretely, the power module or the battery storehouse is configured on the outside wall of the inflatable device, which makes conveniently to be connected to the power supply device or replace new battery. The opening end 100*a* of the shell 100 is covered by the power module or the battery storehouse. In other embodiments, an outer coverage is configured on the opening end 100*a* of the shell 100 for covering the opening end 100*a*.

Concretely, the shell 100 includes not only one layer. For facilitating the connection and the positioning among the drive motor 200, the air bag 300 and the pressing mechanism 400, in this embodiment, the shell 100 includes an outer shell 110, an inner shell 120 and a bottom guide post 130 which together define an inner cavity for receiving the drive motor 200, the air bag 300 and the pressing mechanism 400.

Referring to FIG. 1-3, the drive motor 200 is configured on the axis of the shell 100. The drive motor 200 is nearly a column structure, one end of which is configured on the opening end 100*b*. The output portion 210 of the drive motor 200 is extended to the opening end 100*a* of the shell 100. It is understandable that the drive motor 200 is a micro rotary motor bought from the market.

Referring to FIGS. 2 and 3, the air bag 300 is configured in the shell 100 and around the drive motor 200. Concretely, an internal diameter of the shell 100 is much larger than an external diameter of the drive motor 200. An annular gap is defined by an inside wall of the shell 100 and an outside wall of the drive motor 200 together, the air bag 300 is configured in the annular gap, and the air bag 300 is located between an end of the shell 100 provided with the drive motor 200 and a drive portion of the drive motor 200. That is to say, the air bag 300 is almost at a same height with the drive motor 200 at the axis direction of the shell 100.

In this embodiment, the air bag 300 includes six cylindrical air bags configured around the drive motor 200. Distances between every cylindrical air bag and the drive motor 200 are same. In other embodiments, the distances between cylindrical air bags and the drive motor 200 are different, and the number of the air bag 300 is set as needed. Further, the air bag 300 is an annular air bag, which is formed in an integrated structure and sleeved on the outside wall of the drive motor 200.

In this embodiment, the drive motor 200 is configured on the axis of the shell 100. Six cylindrical air bags 300 are configured around the drive motor 200 compactly. The inner space of the shell 100 can be fully utilized and a volume of the electric inflator can be reduced. At the same time, the inner cavity of the air bag 300 can be bigger than before, and the sizes of the electric inflator and the inner cavity of the air bag 300 can be adjusted when needed.

Furthermore, referring to FIG. 2-3, an inflation leaf 500 is provided at the air bag 300 and faced towards the end of the shell 100 provided with the drive motor 200. An airtight structure is defined by an outer ring of the inflation leaf 500 and an inside wall of the shell 100. A gap is defined between the inflation leaf 500 and the end of the shell 100 provided with the drive motor 200, the air outlet 310 of the air bag 300 is configured at one end of the inflation leaf 500 where is faced to the inflation inlet 150, and an inflating passageway is defined by the air outlet 310 and the inflation inlet 150. Concretely, in this embodiment, as shown in FIG. 3, the inflation leaf 500 and the air bag 300 made of plastic material are formed in an integrated structure, the inflation leaf 500 is shaped to fit with the inner cavity of the shell 100, for example, an interference fit is formed between the inflation leaf 500 configured in the inner cavity of the shell 100 and the inside wall of the shell 100, and an airtight structure is defined between the outer ring of the inflation leaf 500 and the inside wall of the shell 100. A gap is formed between the inflation leaf 500 and an end of the closing end 100*b*. The air outlet 310 is configured at an end of the air bag 300 where the inflation leaf 500 is faced to the inflation inlet 150. The inflating passageway located between the air outlet 310 and the inflation inlet 150 is defined by the gap between the inflation leaf 500 and the inside wall of the shell 100.

To achieve circulatory inflating, the inflation leaf 500 is provided with an air inlet (not shown in the figure) to supply air for the air bag 300, a first check valve (not shown in the figure) for preventing air flowing into the air bag 300 is configured on the air inlet. Concretely, the air firstly is flowed through the first check valve and then is flowed into the gap between the inflation leaf 500 and the inside wall of the shell 100, then the air gets into the air bag 300, thus the air bag 300 is sprang back. Furthermore, a second check valve 151 for preventing air flowing into the inflatable device is configured on the inflation inlet 150.

Referring to FIG. 2-3, a spring support member 320 is configured along an axis direction of the shell 100 and configured in the air bag 300. On the one hand, the shape of the air bag 300 is limited by the spring support member 320 so that it is very stable whether the air bag 300 is in a state of being pressed or extending; on the other hand, the air bag 300 is pressed by the spring support member 320 from inside to outside, thus the air bag 300 will be sprang back quickly thereby improving the inflating efficiency. It is understandable that the spring support member 320 is a linear spring 320 which is sized to fit with the inner cavity of the air bag 300. Preferably, a guide post 160, on which the spring support member 320 is sleeved, is formed by the shell 100 extended towards the air bag 300. In this embodiment, the guide post 160 is located at the gap defined by the inflation leaf 500 and the inside wall of the shell 100, six guide posts 160 are extended from the inside wall of the shell 100 to the air bag 300, a length of the guide post 160 is shorter than that of the spring support member 320 when it is extended. The length of the guide post 160 is shorter than a quarter length of the spring support member 320. When the linear spring 320 is compressed, the liner spring 320 will not be blocked by the guide post 160 because the length of the guide post 160 is shorter.

Figure 4:
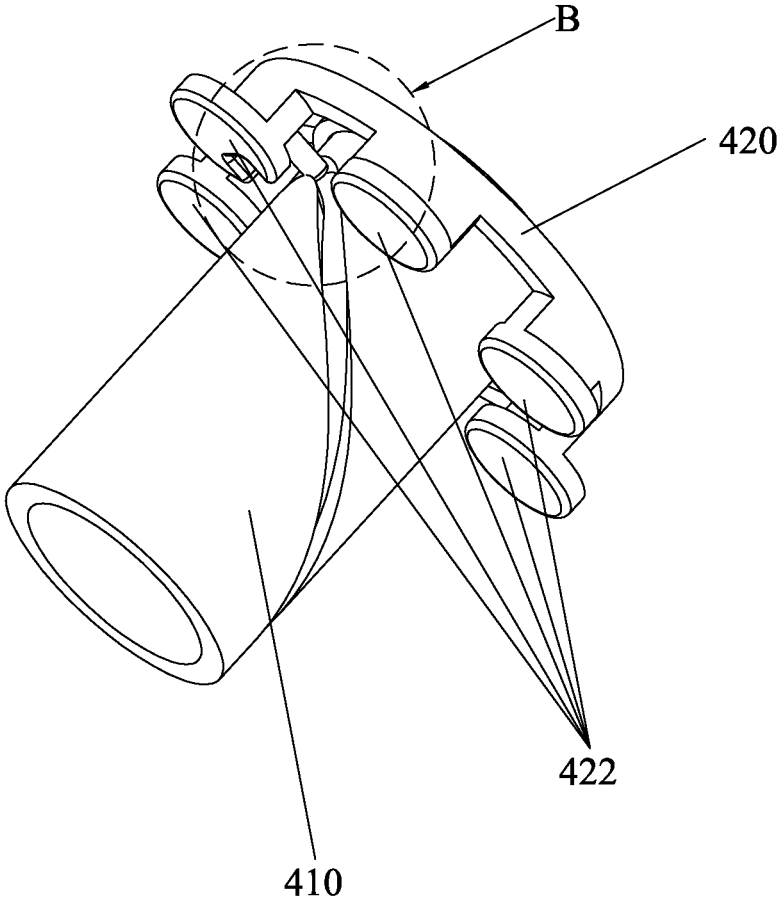
FIG. 4 is a perspective view of the pressing mechanism according to the first embodiment of the present invention.
Figure 5:
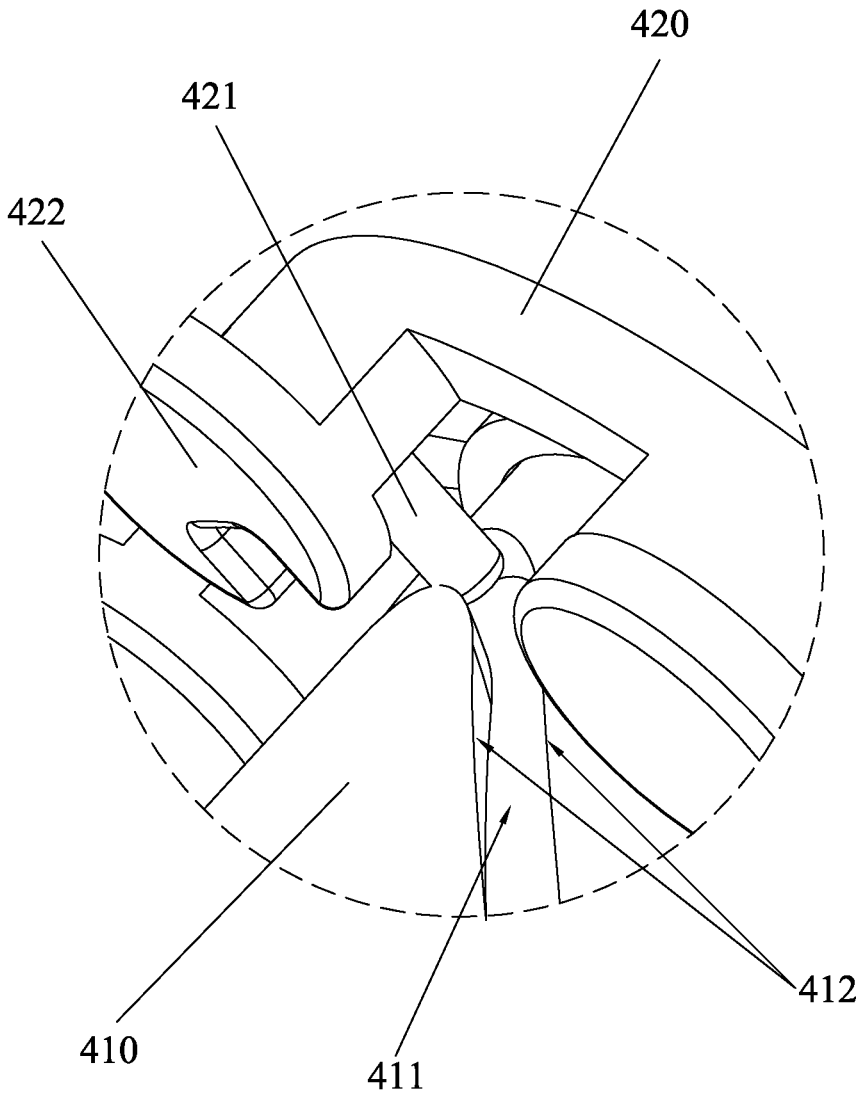
FIG. 5 is an enlarged view of B portion of FIG. 4.
Figure 6:
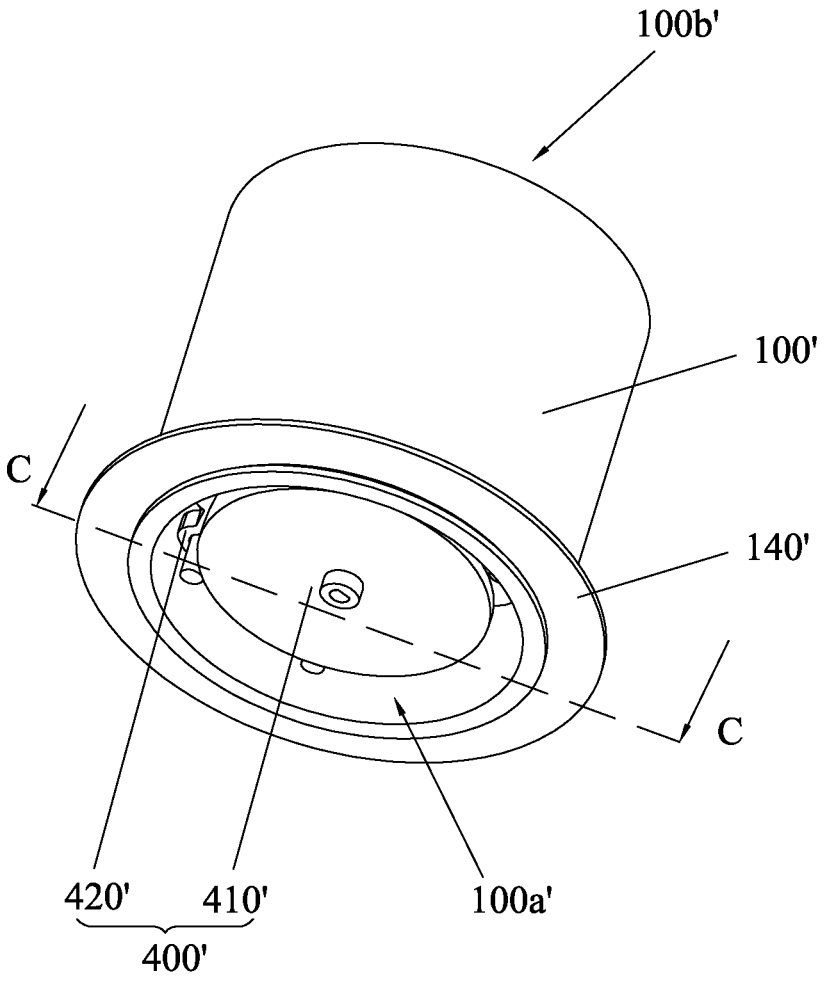
FIG. 6 is a perspective view of an electric inflator according to a second embodiment of the present invention.
Figure 7:
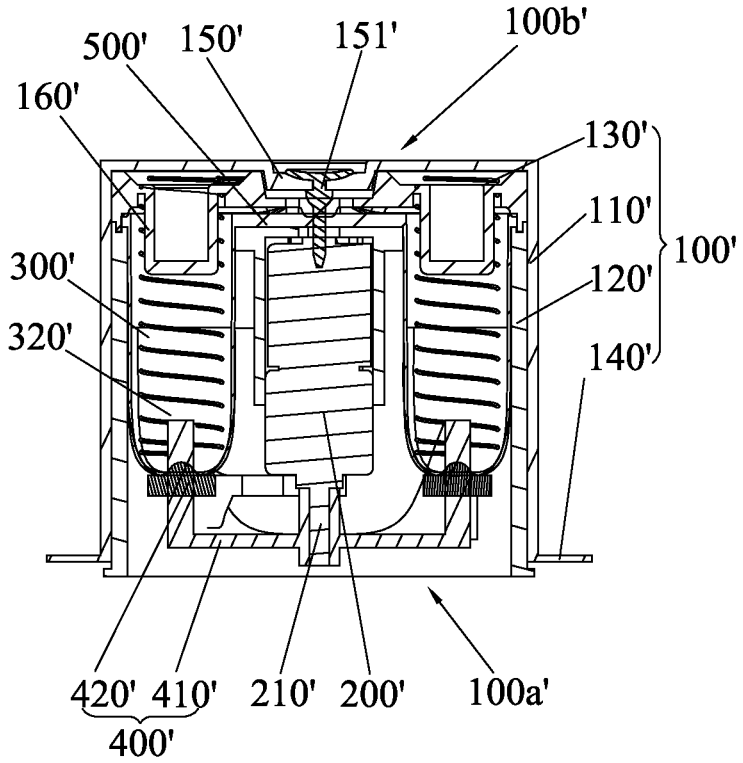
FIG. 7 is a cross section view of the electric inflator according to the second embodiment of the present invention along the direction of C-C.

Referring to FIG. 2-3, the pressing mechanism 400 is connected to the output portion 210 of the drive motor 200. The air bag 300 is pressed by the pressing mechanism 400 which is driven by the drive motor 200 and movable along the axis direction of the shell 100 for blowing air into the inflatable device. Referring to FIG. 4-5, more specifically, in this embodiment, the pressing mechanism 400 includes a driving member 410 and a pressing member 420, and the driving member 410 is sleeved on the outside wall of the drive motor 200 and connected to the output portion 210 of the drive motor 200, and a guide surface 412 is defined by forming a slot 411 around the driving member 410. The pressing member 420 is sleeved on an outside wall of the driving member 410 and limited by the shell 100 to only move along the axis direction of the shell 100. Specifically, a drive end 421 of the pressing member 420 is plugged into the slot 411 and movable along the axis direction of the shell 100 thereby pressing the air bag 300 under a driving action of the guide surface 412.

Referring to FIG. 3-5, in this embodiment, the driving member 410 is a cam driving member, which formed in a cylindrical structure with an opening end corresponding to the drive motor 200. The cam driving member 410 is sleeved on the drive motor 200, the pressing member 420 is nearly an annular structure, an inside wall of the pressing member 420 is sleeved on an outside wall of the cam driving member 410, and an outside wall of an annular pressing member 420 is protruded to form a pressing sections 422 towards the six air bags 300 separately. The pressing member 420 is driven by the guide surface 412 of the cam driving member 410 and movable along the axis direction of the shell 100. The air bag 300 inflated by the pressing section 422 is located between the pressing section 422 and the end of the shell 100 provided with the drive motor 200.

Referring to FIG. 1-5, a working process of the electric inflator according to the first embodiment of the present invention is shown below:

First of all, the drive motor 200 is rotated to drive the cam driving member 410 to rotate along the axis of the shell 100, therefore the pressing member 420 which is movable along the axis direction of the shell 100 is driven by the drive end 421 to move along the direction of the outside wall of the cam driving member 410, then the pressing section 422 is moved close to the closing end 100*b* of the shell 100 to press the air bag 300. In such a way, the air bag 300 is compressed along the direction close to the closing end 100*b* of the shell 100 and the linear spring 320 is deformed, so that the air in the air bag 300 firstly gets into the inflating passageway between the inflation leaf 500 and the inside wall of the shell 100 through the air outlet 310, then the air is flowed into the inner cavity of the inflatable device through the inflation inlet 150.

Secondly, the drive motor 200 continues to be rotated and the cam driving member 410 driven by the drive motor 200 is rotated along the axis of the shell 100. In such a way, the pressing member 420 driven by the drive end 421 and movable along the axis direction of the shell 100 is moved along the outside wall of the cam driving member 410, so that the pressing section 422 is moved along the direction close to the opening end 100*a* of the shell 100 to stop pressing the air bag 300, which is driven by the linear spring 320 and sprang back due to an outer air is flowed into the air bag 300 through an air inlet 510.

Referring to the electric inflator according to the first embodiment of the present invention, the cam driving member 410 is sleeved on the outside wall of the air bag 300 and the pressing member 420 limited by the shell 100 is sleeved on the outside wall of the cam driving member 410. The pressing member 420 is moved along the outside wall of the cam driving member 410 under driving action of the drive end 421 and the cam guide surface 412. Thus the air bag 300 is pressed by the pressing member 420 to inflate the inflatable device. The structure of the electric inflator is compact and reliable due to the pressing member 420 is sleeved on the outside wall of the cam driving member 410, which is sleeved on the outside wall of the air bag 300.

The second embodiment of the present invention is shown in FIG. 6-10. The electric inflator includes a shell 100', a drive motor 200' configured on an axis of the shell 100', at least one air bag 300' configured in the shell 100' and around the drive motor 200', an air outlet 310' of the air bag 300' connected to an inflatable device, a pressing mechanism 400' connected to an output portion 210' of the drive motor 200'. The air bag 300' is pressed by the pressing mechanism 400' driven by the drive motor 200' for blowing air into the inflatable device. An inner space in the shell 100' is fully utilized due to the drive motor 200' is configured on the axis of the shell 100' and the air bag 300' is configured around the drive motor 200'. So that the size of the electric inflator is smaller than before, at the same time, an inner cavity of the air bag 300' is bigger than before, which increases portability and practicability of the electric inflator and the inflatable device equipped with the electric inflator.

Figure 8:
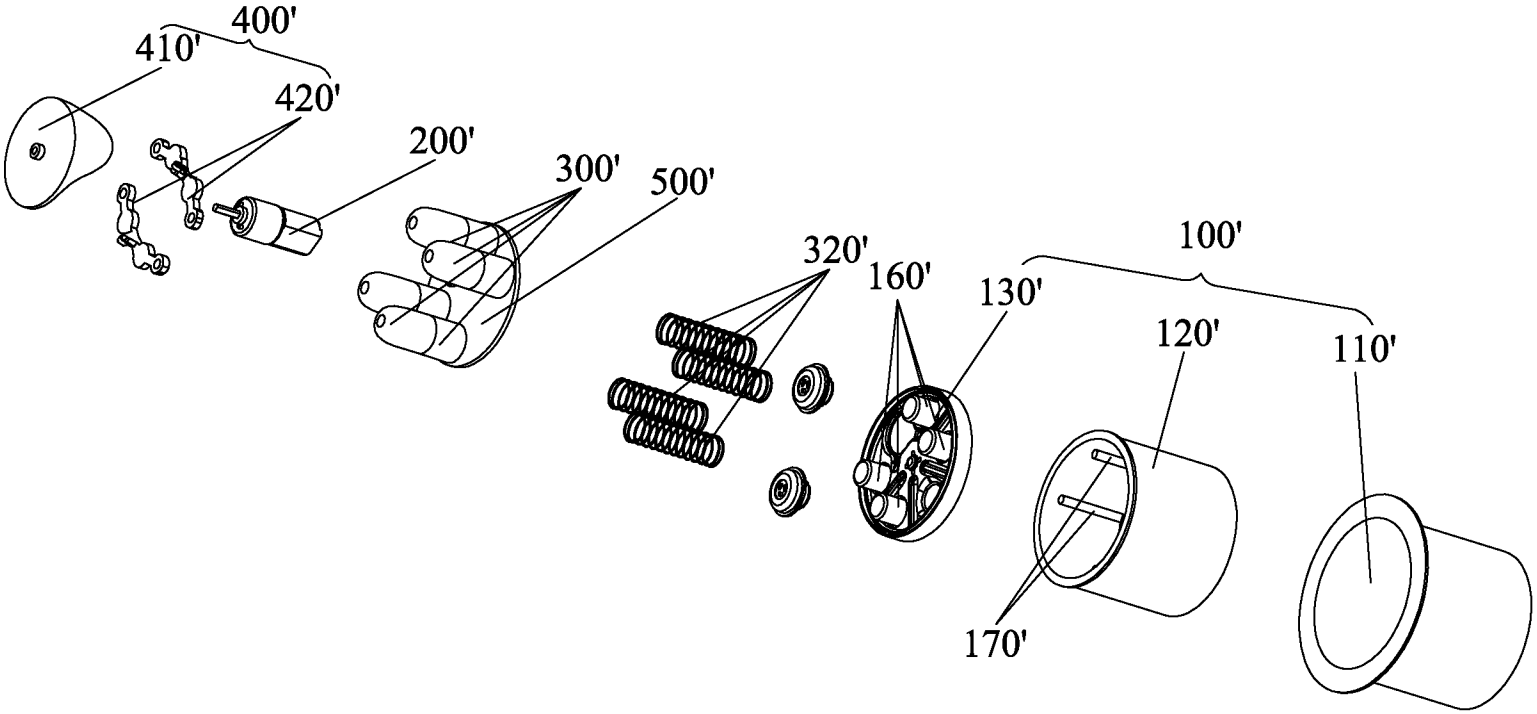
FIG. 8 is an exploded view of the electric inflator according to the second embodiment of the present invention.
Figure 9:
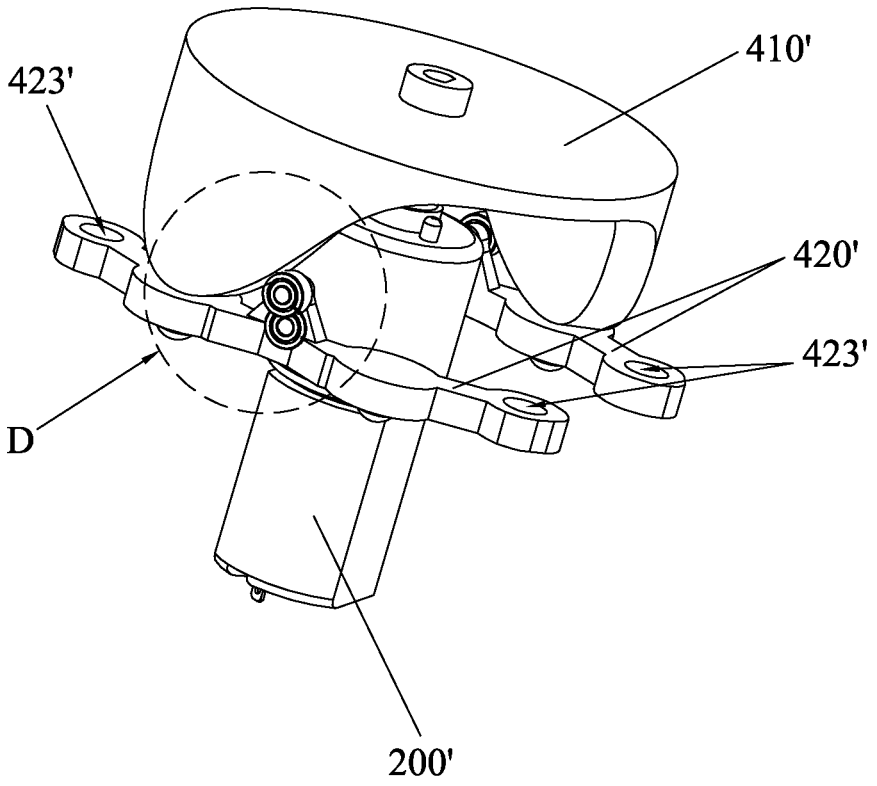
FIG. 9 is a perspective view of the pressing mechanism and the drive motor according to the second embodiment of the present invention.
Figure 10:
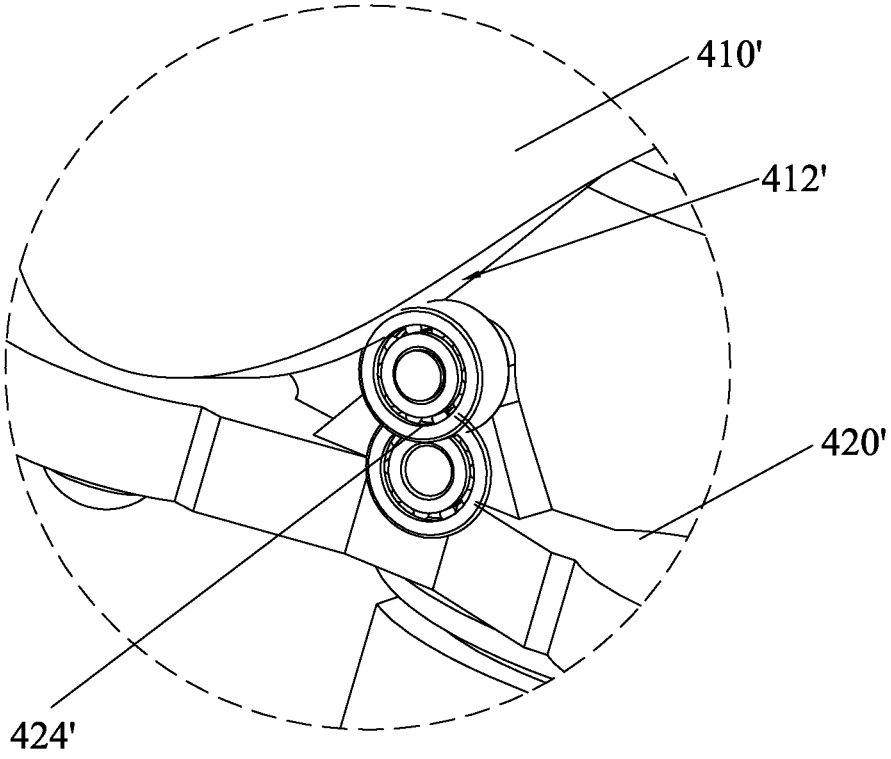
FIG. 10 is an enlarged view of D portion of FIG. 9.

However, different from the first embodiment, referring to FIG. 8-10, a guide axis 170' is configured in the shell 100'. A guide hole 423' is provided on a pressing member 420' to engage with the guide axis 170'. The driving member 410' is a cam driving member, of which the cross section view is a circular structure. The center of the cam driving member 410' is connected to the output portion 210' of the drive motor 200', an outside wall of the cam driving member 410' is protruded towards the air bag 300' to form a cam guide surface 412', and the pressing member 420' configured between the air bag 300' and the cam driving member 410' is limited by the guide axis 170' to be moved along a direction of the guide axis 170'. The drive motor 200' is rotated and the cam driving member 410' driven by the drive motor 200' is rotated. The pressing member 420' driven by the cam guide surface 412' can movable along the direction of the guide axis 170' for pressing the air bag 300'.

Preferably, the number of the pressing member 420' is two. Two pressing members 420' are configured independently and located corresponding to the air bag 300' separately thereby pressing the air bag 300'. A roller 424' is configured on a side wall of the pressing member 420' where is close to the cam guide surface 412' and the roller 424' is adapted for reducing a friction between the pressing member 420' and the cam guide surface 412'.

Preferably, in this embodiment, the number of the air bag 300' is four. Four air bags 300' are divided into 2 groups. Each group includes two air bags 300', which is driven by the pressing member 420'. An air inlet 510' of the inflation leaf 500' is configured between two groups of the air bag 300', a first check valve 520' for preventing air flowing into the air bag 300' is configured on the air inlet 510' and a second check valve 151' for preventing air flowing into the inflatable device is configured on an inflation inlet 150'.

Referring to FIG. 6-10, a working process of the electric inflator according to the second embodiment of the present invention is shown below:

Firstly, the drive motor 200' is rotated to drive the cam driving member 410' to rotate along the axis of the shell 100', the pressing member 420' is pressed by the cam driving member 410' under driving action of the cam guide surface 412' and movable along the direction of the guide axis 170' to press the air bag 300'. In that way, the air bag 300' is compressed towards the opening end 100*b'* of the shell 100', the linear spring 320' is compressed to be deformed, an air in the air bag 300' firstly gets into an inflating passageway formed by the inflation leaf 500' and an inside wall of the shell 100' after passing through the air outlet 310'. The air then is flowed into the inner cavity of the inflatable device after passing through the inflation inlet 150'.

Secondly, the drive motor 200' continues to be rotated and driving the cam driving member 410' to be rotated along the axis of the shell 100'. Then the cam driving member 412' stop pressing the pressing member 420' and the air bag 300' driven by the linear spring 320' is sprang back, the air is flowed into the air bag 300' through an air inlet 510'. At the same time, the pressing member 420' is moved along the direction close to the cam driving member 410'.

In the second embodiment, the air bag 300' is pressed by means of the cam driving member 410', which is driven by the drive motor 200' and under the driving action of the cam guide surface 412' and the roller 424'. Comparing with the electric inflator according to the first embodiment, the electric inflator according to the second embodiment is not required high accurate equipments, so it can reduce the cost.

The electric inflator according to the third embodiment of the present invention is shown in FIG. 11-13, the electric inflator includes a shell 100", a drive motor 200" configured on the axis of the shell 100", at least one air bag 300" configured in the shell 100" and around the drive motor 200", an air outlet 310" of the air bag 300" connected to an inflatable device, and a pressing mechanism 400" connected to an output portion 210" of the drive motor 200". The air bag 300" is pressed by the pressing mechanism 400" which is driven by the drive motor 200" for blowing air into the inflatable device. An inner space in the shell 100" is fully utilized due to the drive motor 200" is configured on the axis of the shell 100" and the air bag 300" is configured around the drive motor 200". Thus the size of the electric inflator is smaller than before. At the same time, an inner cavity of the air bag 300" can be bigger than before, which increases portability and practicability of the electric inflator and the inflatable device equipped with the electric inflator.

However, the electric inflator according to the third embodiment is different from the electric inflators according to the first embodiment and the second embodiment, referring to FIG. 12-13, the air bag 300" is connected to an inside wall of the shell 100", the air outlet 310" of the air bag 300" is configured towards the shell 100", an inflating passageway is configured between the air outlet 310" and an inflation inlet 160" of the shell 100". Preferably, a second check valve 161" for preventing air flowing into the inflatable device is configured on the inflation inlet 160".

The pressing mechanism 400" driven by the electric motor 200" to be rotated along the axis of the shell 100" is formed in a sector structure. A distance between an outside wall of the sector structure 400" and the axis of the shell 100" is longer than that between the air bag 300" and the axis of the shell 100". The sector structure 400" driven by the drive motor 200" is rotated along the axis of the shell 100" thereby pressing the air bag 300".

Concretely, referring to FIG. 12-13, the shell 100" can be divided from outside to inside as a first shell 110", a second shell 120", a third shell 130", a fourth shell 140" and a fifth shell 150". The first shell 110" is an outside shell of the electric inflator, the first shell 110" includes a connecting flange connected to the inflatable device. The second shell 120" is configured in the first shell 110" and the air is flowed through the inflating passageway configured on the second shell 120". The third shell 130" is configured in the second shell 120" and a unidirectional air inlet corresponding to the inflating passageway is configured on the third shell 130". Specifically, a first check valve 121" is configured on the unidirectional air inlet. The fourth shell 140" is configured in the third shell 130". The fourth shell 140" is connected to the air bag 300" and adapted for limiting the air bag 300" in the preset place. The fifth shell 150" is located at bottom of the shell 100" and connected to the inflating passageway of the second shell 120". Referring to FIG. 12-13, the air bag 300" is formed in bowl shape, plenty of the air bags 300" are connected to the inside wall of the fourth shell 140" separately, the air outlet 310" of the air bag 300" is configured towards the second shell 120" and the third shell 130". The pressing mechanism 400" driven by the drive motor 200" is rotated along the axis of the shell 100" thereby pressing the air bag 300". The pressing mechanism 400" stop pressing the air bag 300" after passing through the air bag 300". It is understandable that the air bag 300" which is formed in bowl shape is easier to spring back than the air bag 300 and the air bag 300', which are formed in a columnar structure. So there is no spring support member configured in the air bag 300".

In the third embodiment, several air bags 300" are configured on the inside wall of the shell separately. The sector structure is driven by the drive motor 200" to press the air bag 300" when the sector structure passing through the air bag 300". The sector structure stops pressing the air bag 300" after passing through the air bag 300". Comparing with the electric inflators according to the first embodiment and the second embodiment, the structure of the electric inflator according to the third embodiment is simpler and lower-cost.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An electric inflator, comprising:

a shell;

a drive motor configured on an axis of the shell;

at least one air bag configured in the shell and located beside the drive motor, and provided with an air outlet which is communicated with an inflatable device; and a pressing mechanism connected to an output portion of the drive motor and driven by the drive motor to press the at least one air bag for inflating the inflatable device;

wherein the drive motor is configured at one end of the shell, the output portion of the drive motor connected to the pressing mechanism is configured towards another end of the shell and rotatable along the axis of the shell, and the pressing mechanism comprises a pressing section adapted for pressing the at least one air bag and configured towards an end of the shell where is provided with the drive motor, the at least one air bag is located between the pressing section and the end of the shell where is provided with the drive motor;

the pressing mechanism comprising a driving member connected to the output portion of the drive motor and a pressing member configured in the shell, the pressing member is driven by the driving member and movable along an axis direction of the shell, and the pressing member is protruded towards the at least one air bag to form the pressing section;

the pressing member is sleeved on an outside wall of the drive motor and connected to the output portion of the driving member, a drive end of the pressing member is plugged into the slot and movable along the axis direction of the shell thereby pressing the at least one air bag under a driving action of the guide surface.

2. The electric inflator as claimed in claim 1, wherein the pressing member is connected to an outside wall of the driving member and movable up and down relative to the outside wall of the driving member.

3. The electric inflator as claimed in claim 1, wherein the driving member is connected to the output portion of the drive motor, the pressing member is located between the at least one, air bag and the driving member, a guide surface is defined by an outside wall of the driving member protruded along the axis direction of the shell and towards the pressing member, and the driving member driven by the drive motor is rotatable and movable along the axis direction of the shell under a driving action of the guide surface.

4. The electric inflator as claimed in claim 3, wherein a guide axis is configured in the shell and along the axis direction of the shell, a guide hole is provided on the pressing member to engage with the guide axis.

5. The electric inflator as claimed in claim 1, wherein the at least one air bag comprises a plurality of columnar air bags or an annular air bag configured around the drive motor.

6. The electric inflator as claimed in claim 5, wherein an inflation inlet adapted for inflating the inflatable device is provided at an end of the drive motor, an inflation leaf is provided at the at least one air bag and faced towards the end of the shell provided with the drive motor, an airtight structure is defined by an outer ring of the inflation leaf and an inside wall of the shell, a gap is defined by the inflation leaf and an inner side of the end of the shell provided with the drive motor, the air outlet of the at least one air bag is configured at one end of the inflation leaf where is faced to the inflation inlet, and an inflating passageway is defined by the air outlet and the inflation inlet.

7. The electric inflator as claimed in claim 6, wherein the inflation leaf is provided with an air inlet to supply air for the at least one air bag, a first check valve for preventing air flowing into the at least one air bag is configured on the air inlet and a second check valve for preventing air flowing into the inflatable device is configured on the inflation inlet.

8. The electric inflator as claimed in claim 6, wherein the inflation leaf and the at least one air bag are formed in an integrated structure.

9. The electric inflator as claimed in claim 5, wherein at least one spring support member is configured in the at least one air bag and along the axis direction of the shell.

10. The electric inflator as claimed in claim 9, wherein the shell is extended towards the at least one air bag to form at least one guide post on which the at least one spring support member is sleeved.

11. The electric inflator as claimed in claim 1, wherein the drive motor is configured at one end of the shell, the output portion of the drive motor is configured towards another end of the shell and rotatable along the axis of the shell, the at least one air bag is configured around an inside wall of the shell and located between the output portion of the drive motor and the end of the shell where is provided with the drive motor, the pressing mechanism located between the at least one air bag and the drive motor is driven by the drive motor and rotatable along the axis of the shell thereby pressing the at least one air bag.

12. The electric inflator as claimed in claim 11, wherein the pressing mechanism is a sector structure configured on an outside wall of the drive motor, a distance between an outside wall of the sector structure and the axis of the shell is longer than that between the at least one air bag and the axis of the shell.

13. An electric inflator, comprising;

a shell;

a drive motor configured on an axis of the shell;

at least one air bag configured in the shell and located beside the drive motor, and provided with an air outlet which is communicated with an inflatable device; and a pressing mechanism connected to an output portion of the drive motor and driven by the drive motor to press the at least one air bag for inflating the inflatable device;

wherein at least one spring support member is configured in the at least one air bag and along the axis direction of the shell.

14. The electric inflator as claimed in claim 13, wherein the shell is extended towards the at least one air bag to form at least one guide post on which the at least one spring support member is sleeved.

* * * * *